United States Patent [19]

Lindy

[11] 4,018,699

[45] Apr. 19, 1977

[54] SURFACTANT COMPOSITION

[75] Inventor: Lowell B. Lindy, Midland, Mich.

[73] Assignee: The Dow Chemical Company, Midland, Mich.

[22] Filed: Sept. 29, 1975

[21] Appl. No.: 617,897

Related U.S. Application Data

[63] Continuation-in-part of Ser. No. 525,135, Nov. 19, 1974, abandoned.

[52] U.S. Cl. ..... 252/353; 252/550; 427/373; 428/96; 428/310; 428/341

[51] Int. Cl.² ..... B01F 17/02

[58] Field of Search ..... 252/353, 550, 170, 162; 428/262, 310; 427/373

[56] References Cited

UNITED STATES PATENTS

| | | | |
|---|---|---|---|
| 2,088,085 | 7/1937 | Gross et al. | 252/550 |
| 2,500,107 | 5/1950 | Weichselbaum | 252/550 |
| 3,131,154 | 4/1964 | Klausner | 252/170 |
| 3,497,456 | 2/1970 | Goodell | 252/152 |
| 3,577,554 | 5/1971 | Parrish et al. | 427/373 |
| 3,607,341 | 9/1971 | Goins | 428/310 |
| 3,811,922 | 5/1974 | Clark et al. | 427/373 |
| 3,882,038 | 5/1975 | Clayton et al. | 252/550 |

*Primary Examiner*—Leland A. Sebastian
*Attorney, Agent, or Firm*—I. A. Murphy

[57] ABSTRACT

Surfactant compositions include a mixture of a monobutyl ether of ethylene glycol and a sodium, potassium or magnesium salt of laurylsulfate or mixtures of such salts.

5 Claims, No Drawings

SURFACTANT COMPOSITION

CROSS-REFERENCE TO RELATED APPLICATIONS

This application is a continuation-in-part of application Ser. No. 525,135 filed Nov. 19, 1974, now abandoned.

BACKGROUND OF THE INVENTION

1. Field of the Invention

The invention relates to surfactant compositions for use in latex, especially for application in carpet backings and to a process for preparing and using such compositions.

2. Description of the Prior Art

For many uses of latex compositions, sodium laurylsulfate is a surfactant of choice for inclusion in such compositions because of the many desirable qualities which it contributes. One deficiency of sodium laurylsulfate, however, is that an aqueous solution thereof is not stable, i.e., phase separation and solidification occurs, when the temperature is reduced below about 18° C. One measure which has been taken in the past is to add ethanol or isopropanol to an aqueous solution of sodium laurylsulfate in order to reduce the temperature at which phase separation or solidification occurs.

SUMMARY OF THE INVENTION

The present invention provides surfactant compositions consisting essentially of an aqueous solution of (a) an alkali metal salt, or an ammonium salt or a magnesium salt of laurylsulfate mixtures thereof and (b) a mono-n-butyl ether of ethylene glycol.

In another aspect, the invention provides an improvement in a process of applying a back-sizing and optionally a scrim to a textile article, particularly a carpet, wherein an alkali metal salt, an ammonium, or a magnesium salt of laurylsulfate is mixed with a latex backsizing composition, the resulting mixture is frothed, applied to the textile article and dried, said improvement consisting of adding a mono-n-butyl ether of ethylene glycol before said mixture is frothed. Preferably the butyl ether is pre-blended with the laurylsulfate salt.

DESCRIPTION OF THE PREFERRED EMBODIMENTS

It has been found that a mixture of a mono-n-butyl ether of ethylene glycol with an alkali metal salt, an ammonium salt or a magnesium salt of laurylsulfate provides several advantages in the applications where a salt of laurylsulfate is commonly used. The ratio of sulfate salt/ether usually is in the range 75/25 to 50/50, calculated on a dry weight basis. Use of some excess of the ether does not produce a corresponding improvement in results and too large an excess is disadvantageous. Preferably, about 60 parts by weight of the laurylsulfate salt is used for each 40 parts by weight of the butyl ether.

The combination of a mono-butyl ether of ethylene glycol with an alkali metal salt, an ammonium salt or a magnesium salt of laurylsulfate makes possible the storage and handling of the surfactant at lower temperatures, provides a synergistic effect in that a smaller quantity of the laurylsulfate salt can be used for the same surface activity effects, especially frothing, and in that reduced quantities of thickeners are required.

Furthermore, the glycol ether component of the combination forms an azeotrope with water so that after it has performed the desirable function, the glycol ether can be removed at a temperature below 100° C.

The composition of this invention preferably is prepared by adding the laurylsulfate salt to the mono-butyl ether of ethylene glycol and thoroughly mixing. The reverse addition results in difficulties such as intermediate higher viscosity caused by the formation of gels. For some uses of the composition such as in carpet back-sizing processes which require the formation of a froth (commonly called pan foam), it is possible to obtain the combination by in situ formation, i.e., adding the laurylsulfate salt and the butyl ether separately to part or all of the other compounding ingredients. However, not all of the advantages are obtained in that manner, e.g. the possibility of storage without heating of the laurylsulfate at ambient temperatures occurring in winter in the southern portions of the United States.

One method of use of the compositions of this invention is in the manufacture of tufted carpets, particularly double-backed carpets. Tufted carpets usually are made by looping pile fibers through an inexpensive textile base. These pile loops extending to the backside of the carpet customarily are anchored by the application of a latex adhesive in liquid form. Often a second backing called scrim, is also applied to the backside of the carpet. In the double-backed carpets the latex adhesive anchors the pile fibers, or tufts, and also adheres the scrim to the carpet. The latex adhesive often is applied as a liquid foam by use of a doctor blade, lick roller or other suitable means. The resulting composite, optionally including a scrim, may be passed through nip-rollers and is subsequently heated to dry and cure the latex adhesive. Often the liquid foam collapses partially or completely during the later stages of the process.

The compositions of this invention are advantageously used as a frothing aid to formulate the latex adhesive which is then foamed by whipping or by the use of commercially available foamers such as the Oakes Foamer. While the extent of the foaming can vary considerably, a commonly desired degree can be expressed at about 50 percent air entrapment, e.g. if a specified volume of the unfoamed composition weighs 160 grams, then the same volume of foamed composition would weigh from 75 to 85 grams.

The following examples are given to illustrate more clearly the principle and practice of this invention to those skilled in the art and are not for purposes of limitation. Throughout the specification and claims, all parts and percentages are by weight unless otherwise indicated.

EXAMPLE 1

A blend was prepared by mixing 20 parts of mono-n-butyl ether of ethylene glycol with 100 parts of an aqueous solution containing 30 parts of sodium laurylsulfate. At 20° C., the aqueous solution of sodium laurylsulfate is cloudy but fluid and the above described blend is a clear, very fluid, low viscosity solution. After being kept at a temperature of either 10° C. or 0° C. for 24 hours the blend is still found to be a clear, very fluid, low viscosity solution. In comparison, a sample of the solution containing only sodium laurylsulfate, when observed after 24 hours at 10° C., is found to be a white, semi-solid, non-fluid paste.

EXAMPLE 2

A blend is prepared by mixing 18 parts of mono-n-butyl ether of ethylene glycol with 100 parts of an aqueous solution containing 27 parts of magnesium laurylsulfate. The blend is a clear, very fluid, low viscosity solution when observed at 20° C. or when held for 24 hours at 10° C. or 0° C. In comparison, the aqueous solution containing only 27 parts of magnesium laurylsulfate is a clear, very fluid, low viscosity solution at 20° C., whereas after 24 hours at 10° C. the original solution is found to have separated into two liquid phases or after 24 hours at 0° C. is found to be a white, semi-solid, non fluid paste.

EXAMPLE 3

A blend is prepared by mixing 10 parts of the mono-n-butyl ether of ethylene glycol with 100 parts of an aqueous solution containing 30 parts of ammonium laurylsulfate. The blend is found to be a clear, very fluid, low viscosity solution when observed at 20° C. or after being held at 0° C. for 24 hours. In comparison, the aqueous solution containing only the ammonium laurylsulfate is found to be a clear, very fluid, low viscosity solution at 20° C., but after being held for 24 hours at 0° C. is found to be a white, semi-solid, non-fluid paste.

EXAMPLES 4–8

Textile back-sizing compositions are prepared from the surfactant compositions of this invention by the following recipe:

| | Dry Parts | Total Parts |
|---|---|---|
| Latex (a) | 100 | 200 |
| Calcium carbonate (b) | 400 | 400 |
| Surfactant composition | ( per tables ) | |
| Thickener (c) | 0.8 | 6.6 |

(a) a latex of a copolymer of 52% of styrene, 45% of butadiene and 3% of itaconic acid
(b) No. 10 Whiting
(c) Alcogum 5950, a thickener of the poly acrylate type.

Sufficient water is added to the recipe to provide 75.5 percent solids. In Examples 4 and 5, the components of the surfactant composition are added separately whereas in Examples 6–8, the surfactant compositions (as shown) are pre-blended. In all of the examples, to the latex is added separately the water, the calcium carbonate filler and the surfactant composition. After each addition, the mixture is stirred for about one minute. The thickener is added and the resulting mixture is stirred slowly for 5 minutes at a rate which is insufficient to cause entrainment of air. The viscosity of the mixture obtained thereby is obtained with the Brookfield RVT Viscosimeter using spindle No. 5 at 20 rpm.

A frothability test is carried out in a three step manner as follows:

A 600-gram portion of the formulation is transferred to the bowl of a Hobart Mixer. The mixer is operated at the high speed setting (No. 3 setting) for one minute. A sufficient amount of the frothed material is transferred to a nominal 3-ounce paper cup so that the cup is level full and the weight in grams is recorded as the 1-minute cup weight as the first step. In the second step the contents of the cup is returned to the mixer bowl and whipping is continued for an additional 2 minutes. The paper cup is again filled and weighed in the same manner as in step 1 and the weight in grams is recorded as the 3-minute cup weight. Step 3 is a repetition of step 2 and provides the 5-minute cup weight. These weights can be compared with the weight of the cup level full with an unfrothed portion of the formulation.

The data for Examples 4–8 as well as comparative examples are found in Tables I and II.

TABLE I

| | Example No. 4 | 4x* | 5 | 6 | 6x* |
|---|---|---|---|---|---|
| Surfactant Composition | | | | | |
| Sodium lauryl-sulfate (a) | 1.0 | 1.0 | 1.0 | 0.6 | 0.6 |
| Mono-n-butyl ether of ethylene glycol (parts) | 0.5 | — | 1.0 | 0.4 | — |
| Properties | | | | | |
| Viscosity, cps, (b) | 9140 | 9100 | 9300 | 10400 | 13200 |
| Cup weights prior to frothing | 160 | 160 | 160 | 160 | 160 |
| 1-minute | 102.2 | 113.7 | 102.2 | 123.2 | 124.9 |
| 3-minute | 48.5 | 70.6 | 46.5 | 82.6 | 97.1 |
| 5-minute | 36.0 | 52.8 | 32.5 | 57.8 | 82.8 |

*Not examples of the invention
(a) parts, active, added as a 30% aqueous solution,
(b) Brookfield, spindle No. 5, 20 rpm

TABLE II

| | Example No. 7 | 7x* | 8 | 8x* |
|---|---|---|---|---|
| Surfactant Composition | | | | |
| Lauryl sulfate salt | | | | |
| magnesium (a) | 0.6 | 0.6 | | |
| ammonium (b) | | | 0.6 | 0.6 |
| Mono-n-butyl ether | | | | |

TABLE II-continued

| | Example No. 7 | 7x* | 8 | 8x* |
|---|---|---|---|---|
| Surfactant Composition | | | | |
| of ethylene glycol (parts) | 0.4 | — | 0.4 | — |
| Properties | | | | |
| Viscosity, cps (c) | 8200 | 11400 | 8200 | 11600 |
| Cup weights prior to frothing | 160 | 160 | 160 | 160 |
| 1-minute | 110.5 | 124.6 | 116.9 | 129.9 |
| 3-minute | 65.0 | 94.5 | 77.2 | 102.6 |
| 5-minute | 43.0 | 79.0 | 53.9 | 87.2 |

*Not examples of the invention
(a) active parts, added as a 27% aqueous solution
(b) active parts, added as a 30% aqueous solution
(c) Brookfield, No. 5 spindle, 20 rpm.

EXAMPLES 9–10

Other back-sizing compositions are prepared and tested in the same manner as described for Examples 6–8 except that different latexes are used and except for any changes specifically noted below. The results are shown in Table III.

In Example 9 and in comparative example 9x, the latex is an acrylic copolymer latex sold commercially as Rhoplex B-15.

In Example 10 and in comparative examples 10x and 10y the polymer comprising the latex is a copolymer of 60 percent of styrene and 40 percent of butadiene, the amount of calcium carbonate is 250 parts, 1 part of tetrasodium pyrophosphate (TSPP) is added; and the solids content is 71.6 percent. Additionally the amount of thickener was altered, such amount being 0.9 part for each of examples 10 and 10y and 0.5 part for example 10x.

TABLE III

| | Example No. 9 | 9x* | 10 | 10x* | 10y* |
|---|---|---|---|---|---|
| Latex | | | | | |
| Acrylic (a) | 100 | 100 | | | |
| Styrene/butadiene (a) | | | 100 | 100 | 100 |
| Surfactant Composition | | | | | |
| Sodium laurylsulfate (b) | 0.6 | 1.0 | 0.48 | 0.48 | 0.8 |
| Mono-n-butyl ether of ethylene glycol, parts | 0.4 | — | 0.32 | — | — |
| Properties | | | | | |
| Viscosity, cps (b) | 3220 | 2840 | 15400 | 4200 | 18000 |
| Cup weights, grams prior to frothing | 156 | 156 | 133 | 133 | 133 |
| 1-minute | 77.8 | 76.0 | 55.4 | 101.0 | 72.6 |
| 3-minute | 44.0 | 41.9 | 27.8 | 60.4 | 37.0 |
| 5-minute | 38.8 | 36.7 | 24.8 | 39.1 | 24.7 |

*Not examples of the invention
(a) parts, solids basis
(b) parts, active, added as a 30% aqueous solution
(c) Brookfield, No. 5 spindle, 20 rpm.

EXAMPLE 11

Substantially the same results are obtained when potassium laurylsulfate is substituted for sodium laurylsulfate in Example 1 and in Example 6.

In the foregoing examples, for the same cup weights prior to foaming, a larger decrease in the cup weights after foaming indicates an increase in efficiency of the surfactant composition.

That which is claimed is:

1. A surfactant composition consisting essentially of an aqueous solution of (a) an alkali metal salt, or an ammonium salt, or a magnesium salt of laurylsulfate, or mixtures thereof and (b) a mono-n-butyl ether of ethylene glycol.

2. The surfactant composition of claim 1 in which the weight of the salt of laurylsulfate is from about 1 to about 3 times the weight of the ether.

3. The surfactant composition of claim 1 in which about 40 parts of said ether is used for each 60 parts of said salt.

4. In a process for applying a back-sizing and optionally a scrim to a textile article wherein an alkali metal salt, an ammonium salt or a magnesium salt of laurylsulfate is mixed with a latex back-sizing composition, the resulting mixture is frothed, applied to the textile article, and dried, the improvement of adding a mono-n-butyl ether of ethylene glycol before said mixture is frothed.

5. The process of claim 4 wherein said butyl ether is blended with said salt of laurylsulfate.

* * * * *